US009010551B2

(12) United States Patent
Nero et al.

(10) Patent No.: US 9,010,551 B2
(45) Date of Patent: Apr. 21, 2015

(54) WIRE ACCESS LINE DRUM ASSEMBLY

(75) Inventors: Kenneth Michael Nero, Houston, TX (US); Walter Thomas Coram, Houston, TX (US); William Raymond Valentine, Burleson, TX (US); Kevin Bryan Lewis, Burleson, TX (US)

(73) Assignee: Maverick Precision Manufacturing, Ltd., Houston, TX (US)

( * ) Notice: Subject to any disclaimer, the term of this patent is extended or adjusted under 35 U.S.C. 154(b) by 219 days.

(21) Appl. No.: 13/186,719

(22) Filed: Jul. 20, 2011

(65) Prior Publication Data

US 2013/0020271 A1 Jan. 24, 2013

(51) Int. Cl.

| | |
|---|---|
| ***A47F 7/00*** | (2006.01) |
| ***B66D 1/30*** | (2006.01) |
| ***B66D 1/34*** | (2006.01) |
| ***B65H 75/08*** | (2006.01) |
| ***B65H 75/14*** | (2006.01) |
| ***B65H 75/42*** | (2006.01) |

(52) U.S. Cl.

CPC .. *B66D 1/30* (2013.01); *B66D 1/34* (2013.01); *B65H 75/08* (2013.01); *B65H 75/14* (2013.01); *B65H 75/42* (2013.01)

(58) Field of Classification Search

USPC ..... 242/125.1, 118, 118.62, 125.2, 125; 211/88.5, 85.5; 108/53.1, 55.1, 55.3

See application file for complete search history.

(56) References Cited

U.S. PATENT DOCUMENTS

| | | | | | |
|---|---|---|---|---|---|
| 173,419 | A * | 2/1876 | Potter | ..... | 242/125.1 |
| 823,401 | A * | 6/1906 | Ferris | ..... | 242/586.2 |
| 1,577,671 | A * | 3/1926 | Ashmead et al. | ..... | 242/125.1 |
| 1,807,582 | A * | 6/1931 | Brown | ..... | 242/125.1 |
| 2,025,890 | A * | 12/1935 | Payne | ..... | 242/125.1 |
| 2,344,132 | A * | 3/1944 | Coxe | ..... | 242/118.8 |
| 2,811,322 | A * | 10/1957 | Wilkinson | ..... | 242/586.1 |
| 2,898,054 | A * | 8/1959 | Rea | ..... | 242/476.3 |

(Continued)

FOREIGN PATENT DOCUMENTS

| | | | | |
|---|---|---|---|---|
| CN | 102030278 A | 4/2011 | ..... | B66D 1/28 |
| EP | 2 274 970 A3 | 1/2011 | ..... | A01G 9/22 |

(Continued)

OTHER PUBLICATIONS

Search Report issued by the UK Intellectual Property Office in connection with the UK Patent Application No. 1212210.7 dated Oct. 16, 2012.

*Primary Examiner* — Jose V Chen

(74) *Attorney, Agent, or Firm* — Williams Morgan, P.C.

(57) ABSTRACT

One aspect of the disclosed subject matter is seen in a wire access line drum assembly, comprising a tubular drum, first and second end portions, and a shaft. The tubular drum includes a first end, a second end, and an inner diameter of a first preselected size. The first and second end portions are coupled to the first and second ends of the tubular drum, and the shaft extends at least partially within the tubular drum. The shaft has an outer diameter of a second preselected size substantially similar to the first preselected size. Another aspect of the disclosed subject matter is seen in a drum storage system. The drum storage system is comprised of a plurality of wire access line drums and a rack. The plurality of wire access line drums each have a wire access line pre-spooled thereon, and the rack is designed to receive the plurality of wire access line drums in a configuration to permit one or more of the wire access lines to be retrieved from the rack and transported to a job site.

19 Claims, 11 Drawing Sheets

(56) References Cited

U.S. PATENT DOCUMENTS

| | | | | | |
|---|---|---|---|---|---|
| 3,084,803 | A | * | 4/1963 | Bayers | 211/85.5 |
| 3,326,494 | A | * | 6/1967 | Hartley, Jr. | 242/125.1 |
| 3,430,773 | A | * | 3/1969 | Hancock | 211/85.5 |
| 4,160,532 | A | * | 7/1979 | Demuth et al. | 242/125.1 |
| 4,387,863 | A | * | 6/1983 | Edmonston et al. | 242/118.4 |
| 4,657,203 | A | | 4/1987 | Crawford | 242/125.1 |
| 4,715,549 | A | * | 12/1987 | Travlos | 242/125.1 |
| 4,796,830 | A | * | 1/1989 | Gelfman | 242/125.1 |
| 4,828,200 | A | * | 5/1989 | Adams et al. | 242/125.1 |
| 4,832,281 | A | * | 5/1989 | Payne et al. | 242/125.1 |
| 4,938,432 | A | * | 7/1990 | Kurt et al. | 242/125.1 |
| 5,228,821 | A | * | 7/1993 | Gleffe et al. | 108/53.1 |
| 5,236,145 | A | * | 8/1993 | Floury et al. | 242/118.61 |
| 5,246,184 | A | * | 9/1993 | Trewhella, Jr. | 242/125.1 |
| 5,460,333 | A | * | 10/1995 | Vanhuyse | 242/125.1 |
| 5,692,625 | A | * | 12/1997 | Filipescu et al. | 211/85.5 |
| 7,407,129 | B2 | * | 8/2008 | Robitaille et al. | 242/422.4 |
| 7,765,928 | B2 | * | 8/2010 | Bieber et al. | 242/125.1 |
| 7,819,354 | B2 | * | 10/2010 | Robitaille et al. | 206/391 |

FOREIGN PATENT DOCUMENTS

| | | | |
|---|---|---|---|
| NO | GB 1435485 A | 11/1974 | B66D 1/36 |
| WO | WO 99/24345 | 5/1999 | B65H 75/14 |

* cited by examiner

WIRE ACCESS LINE DRUM ASSEMBLY

CROSS-REFERENCE TO RELATED APPLICATIONS

Not applicable.

BACKGROUND

The disclosed subject matter relates generally to well access lines and, more particularly, to a drum assembly for storing and deploying a well access line, wherein the drum assembly resists undesirable deformation and/or crushing when employed in a high-stress environment.

Drilling, completing and producing hydrocarbon and other wells are generally complicated and expensive operations. Accordingly, monitoring the condition of the well and performing routine maintenance on the well are useful in maintaining its proper health so as to extend the useful life of, and production from, the well.

Such monitoring and maintenance of the well is generally provided by a well access line stored on and deployed from a drum assembly positioned adjacent the wellbore. The well access line may take on any of a variety of forms, such as a coiled tubing line capable of delivering a fluid therethrough and into the wellbore, a wireline configured to deliver a well tool downhole into the well, etc.

In some environments, the well may extend to a very significant depth. Accordingly, for the well access line to extend to a desired depth within the well, it may need to be several thousand feet in length, and thus will have a very substantial weight. Given the substantial length and weight of some well access lines that are stored on the drum assembly, it should be appreciated that the well access line may exhibit substantial forces on the drum assembly, which can lead to undesirable deformation or even crushing of the drum.

During a conventional wireline procedure, several thousand feet of wireline cable may be provided to the oilfield wrapped about the drum assembly. Conventionally, a wireline procedure begins with a logging tool being coupled to the wireline and lowered into the well by controllably rotating the drum assembly. With the tool positioned downhole, the wireline is then pulled uphole by a reverse rotation of the drum assembly as the logging application proceeds, recording information relative to the well and surrounding formation. In this manner, a log revealing an overall profile of the well may be established, with measurements being recorded continuously as a function of depth in the well.

Similarly, during a coiled tubing procedure, several thousand feet of coiled tubing may be provided to the oilfield by way of the drum assembly. The coiled tubing may be delivered into the well in order to perform an operation within the well. For example, the coiled tubing may be employed in a clean out operation. That is, the coiled tubing may be equipped with a spray tool and directed to an area of accumulated debris within the well. In this manner, a fluid may be pumped through the coiled tubing in order to clean out the debris within the well. The coiled tubing may then be pulled uphole and out of the well for subsequent well operations.

During these types of procedures, the drum assembly can be subjected to a significant amount of strain and tension from the load placed thereon by the line. For example, withdrawing the well access line from the well places a significant amount of stress on the drum assembly. That is, tension is exerted on the drum assembly during this pulling as a result of the weight of the line and any tools disposed thereon. Additional tension is also exerted on the drum as a result of the friction of the line and the tool being dragged up against the interior surface of the wellbore. Furthermore, there may be a significant amount of fluid resistance to the tool being removed, especially if the rate of removal is relatively high. The cumulative effects of such tension may lead to undesirable deformation or even crushing of the drum assembly. Unfortunately, replacing the drum assembly can be prohibitively expensive, in some cases costing $80,000 or more.

Furthermore, the frequency of drum replacement for well access operations has risen sharply in the last several years and is likely to continue rising. This may be at least partially due to the types of wells that are becoming more and more common. That is, in today's hydrocarbon recovery industry, highly deviated and tortuous wells are becoming more and more common along with deeper and deeper wells. As a result, the tension of the line on the drum is increased due to the added amount of friction and fluid resistance that accompany such wells as well as the added weight of the longer line. These rising forces associated with modern wells have dramatically reduced the life expectancy of a conventional drum assembly, and thus, have significantly increased operating costs.

BRIEF SUMMARY

The following presents a simplified summary of the disclosed subject matter in order to provide a basic understanding of some aspects of the disclosed subject matter. This summary is not an exhaustive overview of the disclosed subject matter. It is not intended to identify key or critical elements of the disclosed subject matter or to delineate the scope of the disclosed subject matter. Its sole purpose is to present some concepts in a simplified form as a prelude to the more detailed description that is discussed later.

One aspect of the disclosed subject matter is seen in a wire access line drum assembly, comprising a tubular drum, first and second end portions, and a shaft. The tubular drum includes a first end, a second end, and an inner diameter of a first preselected size. The first and second end portions are coupled to the first and second ends of the tubular drum, and the shaft extends at least partially within the tubular drum. The shaft has an outer diameter of a second preselected size substantially similar to the first preselected size.

Another aspect of the disclosed subject matter is seen in a drum storage system. The drum storage system is comprised of a plurality of wire access line drums and a rack. The plurality of wire access line drums each have a wire access line pre-spooled thereon. The rack is designed to receive the plurality of wire access line drums in a configuration to permit one or more of the wire access lines to be retrieved from the rack and transported to a job site.

BRIEF DESCRIPTION OF THE SEVERAL VIEWS OF THE DRAWINGS

The disclosed subject matter will hereafter be described with reference to the accompanying drawings, wherein like reference numerals denote like elements, and.

Figure 1:
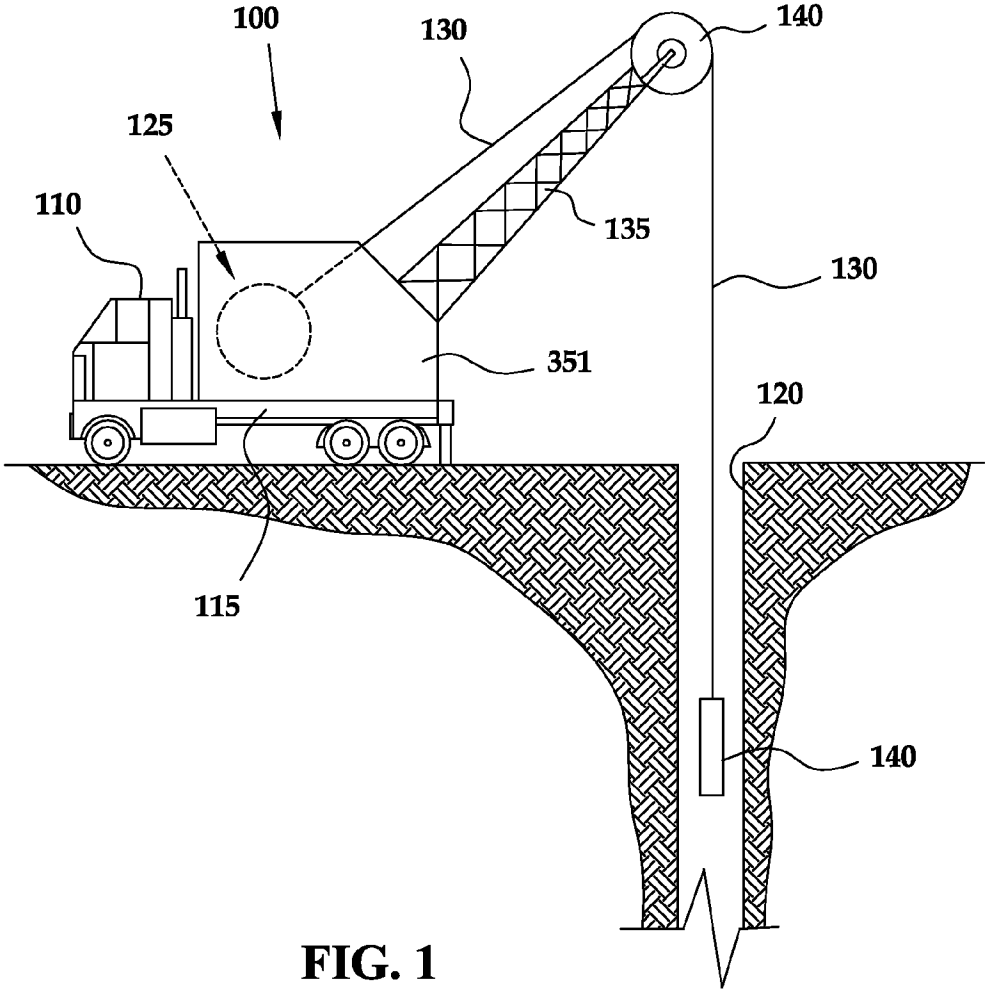
FIG. 1 is a stylistic side view of a vehicle having a wire access line drum assembly disposed thereon and positioned adjacent a wellbore.

While the disclosed subject matter is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DETAILED DESCRIPTION

One or more specific embodiments of the disclosed subject matter will be described below. It is specifically intended that the disclosed subject matter not be limited to the embodiments and illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions may be made to achieve the developers' specific goals, such as compliance with system-related and business related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure. Nothing in this application is considered critical or essential to the disclosed subject matter unless explicitly indicated as being "critical" or "essential."

The disclosed subject matter will now be described with reference to the attached figures. Various structures, systems and devices are schematically depicted in the drawings for purposes of explanation only and so as to not obscure the disclosed subject matter with details that are well known to those skilled in the art. Nevertheless, the attached drawings are included to describe and explain illustrative examples of the disclosed subject matter. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Referring now to the drawings wherein like reference numbers correspond to similar components throughout the several views and, specifically, referring to FIG. 1, the disclosed subject matter shall be described in the context of being disposed on a vehicle 100. Those skilled in the art will recognize that a vehicle 100 useful for transporting a wire access line drum 125 may take on any of a variety of forms, and that other components in addition to those explicitly set forth herein may be useful in various applications. However, to avoid obfuscating the embodiments described herein, only those components useful to an understanding of the present embodiment are included. Additionally, those skilled in the art will appreciate that the wire access line drum 125 may be mounted on a separate trailer or conventional skid unit and then transported to a job site via a truck, forklift, crane, boat, helicopter and the like. Further, the truck or skid may be configured with a plurality of wire access line drum assemblies.

In one embodiment, the vehicle 100 may take the form of a truck 105 having a cab portion 110 and a bed potion 115. The cab portion 110 may be of a conventional configuration with an operator compartment arranged with various controls to effect steering, acceleration, deceleration and the like so that the vehicle 100 may be driven or otherwise transported from one job site to another, and positioned adjacent a wellbore 120. The bed portion 115 may include one or more drum assemblies 125 with a well access line 130 located thereon. The well access line 130 may take any of a variety of forms, such as a coiled tubing line, a wireline, and the like.

Those skilled in the art will appreciate that the drum assembly 125 may be alternately, controllably rotated in both forward and reverse directions to allow the well access line 130 to be lowered into or removed from the wellbore 120. Rotation of the drum assembly 125 may be accomplished by a conventional system that may include a motor and transmission (not shown) that may be separate from or associated with a primary motor and transmission that may also be used to move the truck 105.

In some embodiments, it may be useful for the bed portion 115 to also include a conventional mast assembly 135 and pulley 140 that may be controllably extended or retracted to orient the well access line 130 relative to the wellbore 120. After the mast assembly 135 has been moved to its desired location, then the well access line 130 with a tool 140 attached thereto may be lowered into or withdrawn from the wellbore 120 by rotating the drum assembly 125 in the appropriate direction.

Figure 2A:
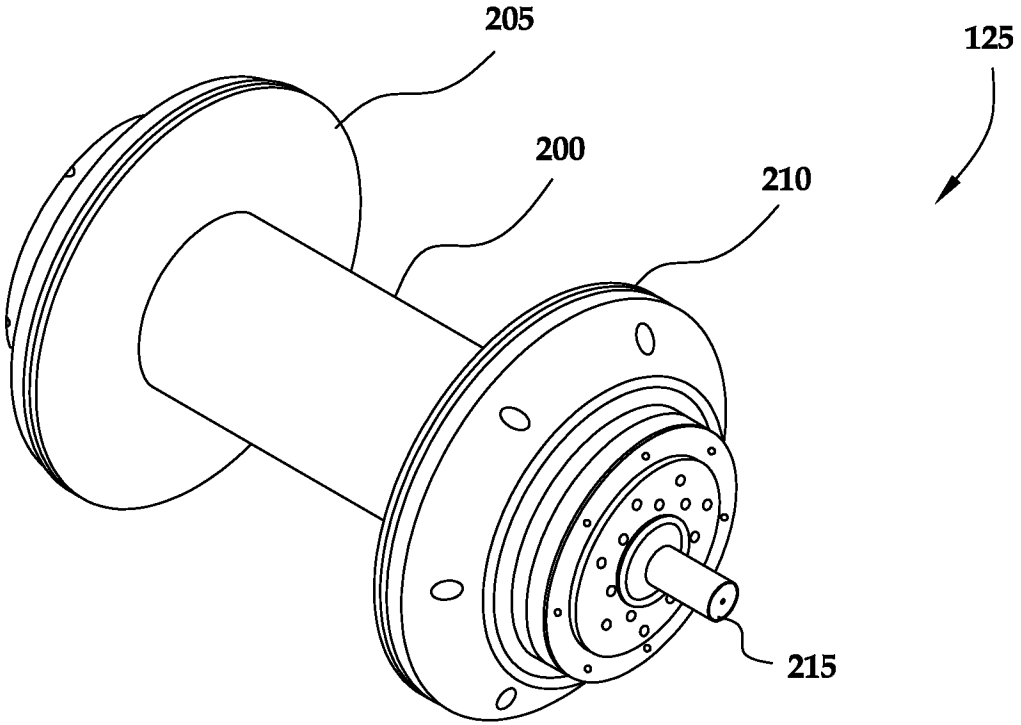
FIGS. 2A-2B are perspective views of one embodiment of a wire access line drum assembly of FIG. 1.

Turning now to FIG. 2A, a perspective view of the drum assembly 125 is shown. The drum assembly 125 is comprised of a drum 200 with first and second end portions 205, 210 disposed at opposite ends of the drum 200. A shaft or axle 215 extends longitudinally through the drum 200 and is received within the drum 200 in a relatively close fitting configuration such that the shaft 215 provides additional support to the drum 200 to reduce the likelihood that the drum 200 may be deformed or crushed by stress exerted thereon by the well access line 130.

Figure 2B:
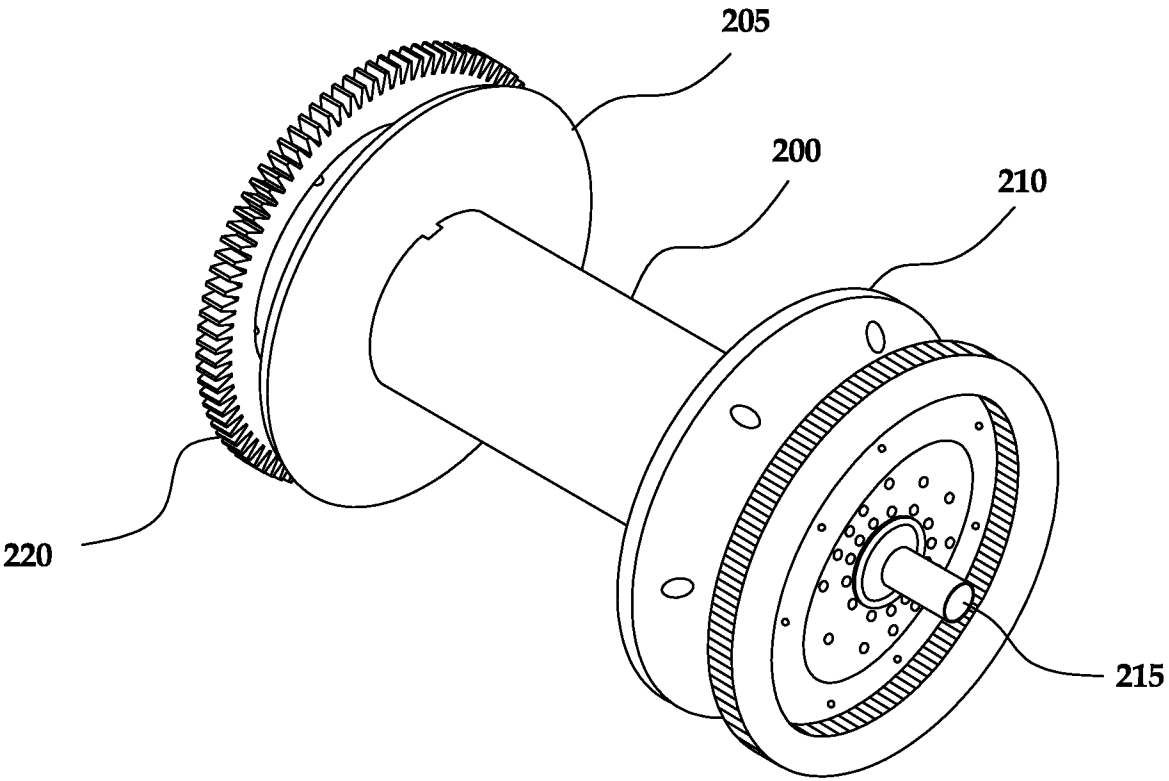

In the illustrated embodiment, the shaft 215 extends beyond the end portions 205, 210 and may be captured within bearings and a fixed mounting (not shown) on the bed portion 115 of the truck 105 so that the drum assembly 125 is relatively fixed against longitudinal or lateral movement, but remains free for rotational movement. Those skilled in the art will appreciate that at least one of the end portions 205, 210 may be coupled to a conventional drive mechanism (not shown) suitable for controllably rotating the drum assembly 125 in forward and reverse directions. For example, as shown in FIG. 2B a toothed ring or sprocket 220 may be fixedly coupled to one or more of the end portions 205, 210 such that the teeth may be engaged by a chain, gear, or like drive mechanism to effect rotation of the drum assembly 125. An opposite end of the drum assembly 125 may include a brake rotor 220 that may be engaged with a caliper and brake pads (not shown) to controllably slow or stop the drum assembly, as desired. In the illustrated embodiment, the toothed ring 220 is coupled to the first and second end portions 205, 210 via bolts, but those skilled in the art will appreciate that other fastening mechanisms may be readily substituted. For example, the toothed ring 220 may be riveted, pinned, screwed, welded or otherwise mechanically fastened to one or more of the end portions 205, 210.

Figure 3:
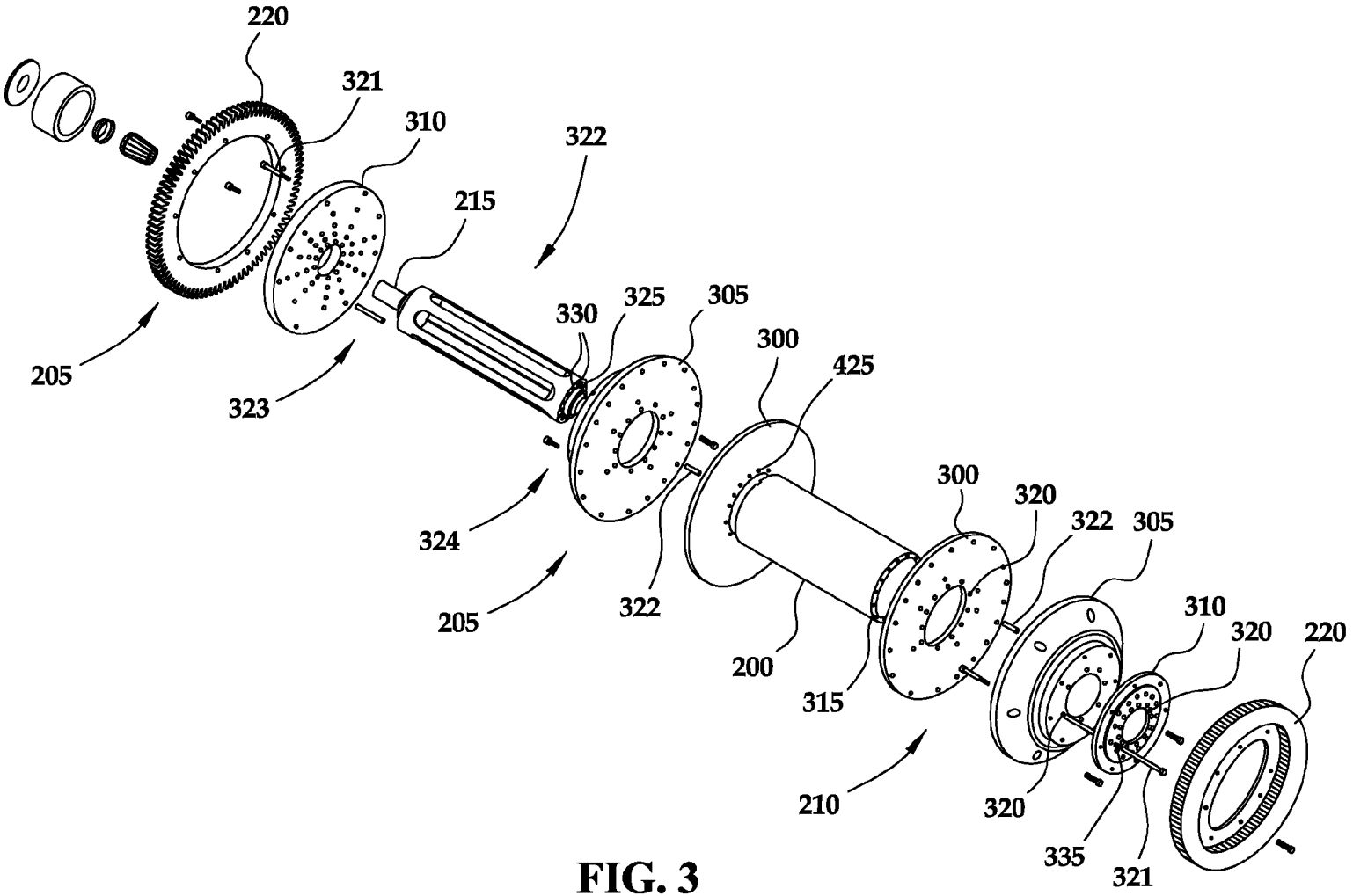
FIG. 3 is an exploded perspective view of one embodiment of a wire access line drum assembly of FIGS. 1 and 2.

Turning now to FIG. 3, an exploded perspective view of the drum assembly 125 is shown. In the illustrated embodiments, the end portions 205, 210 are substantially similar in construction, with each being constructed from three distinct pieces, an interior plate 300, an exterior plate 305, and an end cap 310. In one embodiment, the drum 200 is tubular in configuration and has a plurality of threaded boreholes 315 extending longitudinally therein. The interior and exterior plates 300, 305 and the end cap 310 have matching boreholes 320 that allow properly sized bolts 321 to be passed therethrough to securely couple the interior plate 300, exterior plate 305, and end cap 310 to the drum 200.

The interior and exterior plates 300, 305 are configured with a central bore having a diameter substantially similar to the inner diameter of the tubular drum 200 and sufficiently large to allow the shaft 215 to pass therethrough. The shaft 215 has a central region 322 and two substantially similar end portions 323, 324. The end portions 323, 324 have a reduced diameter, as compared to the central region 322, and thus a shoulder 325 is formed on the shaft 315. The endcap 310 also has a central bore passing therethrough, but it has a slightly smaller diameter that is less than the total outer diameter of the shaft 215 such that the shoulder 325 engages the end cap 310. The shoulder 325 has a plurality of threaded boreholes 330 extending longitudinally therein. The interior and exterior plates 300, 305 and the end cap 310 have matching boreholes 320 that allow properly sized bolts to be passed therethrough and into the threaded boreholes 315 to securely couple the interior plate 300, exterior plate 305, and end cap 310 to the drum 200. The end cap 310 also has boreholes 335 that substantially align with the threaded boreholes 330 in the shoulder 325 of the shaft 315. Properly sized bolts 321 may be passed through the boreholes 335 and into the threaded boreholes 330 to securely couple the end cap 310 to the shaft 215 and positively retain the shaft 215 within the drum assembly 125. In some embodiments, it may be useful to include an alignment pin 322 between the interior and exterior plates 300, 305 to assist in aligning the plates 300, 305 during assembly. Likewise, an alignment pin 323 may extend between at least the exterior plate 305 and the end cap 310 to assist in aligning the exterior plate 305 with the end cap during assembly.

Turning now to FIGS. 4A-4D, various views of the shaft 215 are diagrammatically shown. In some embodiments, the central region 322 of the shaft 215 may have a tubular cross section to reduce weight without substantially reducing its ability to resist crushing or deformation of the drum 200. Alternatively, the central region 322 may be a substantially solid body, but still obtain weight savings by having longitudinal slots 400 formed therein. In the illustrated embodiment, the slots 400 are shown extending along a substantial uninterrupted longitudinal portion of the central region 322; however, other configurations are envisioned. For example, each of the slots 400 may be configured as two or more longitudinal slots that extend for only a limited portion of the longitudinal length of the central region 322. Moreover, it is envisioned that the each of the slots 400 may be formed from a plurality of longitudinal slots that are at least slightly longitudinally misaligned relative to an adjacent one of the plurality of longitudinal slots. That is each adjacent slot may be offset slightly so as to not be longitudinally aligned. Such an arrangement may enhance the ability of the shaft 215 to resist deformation or crushing of the drum 200.

The outer diameter of the central region 322 of the shaft 215 is selected to be substantially similar to the inner diameter of the drum 200 so that the outer surface of the central region 322 is closely spaced to the inner surface of the drum 200. This close spacing between the shaft 215 and the drum 200 allows the shaft to provide additional support to prevent the drum 200 from deforming or being crushed during operation in high-stress conditions. This additional support substantially increases the useful life of the drum assembly 125, such that the operating cost of the well access line 130 is greatly reduced.

In an alternative embodiment of the shaft 215, the central region 322 may have a tubular cross section with a plurality of longitudinal slots 400. The radial depth of the longitudinal slots 400 may be selected such that the slots 400 extend partially into or totally through the tubular wall so as to form a cage like structure.

In the illustrated embodiment, the end portions 323, 324 are substantially similar in configuration and have a first and second region 405, 410 each with slightly smaller diameters. It is envisioned that the end portions 323, 324 may be constructed of multiple regions, each having a different diameter, or a single region having a single diameter. In one embodiment, the end portions 323, 324 are integrally formed with the central region 322. In other embodiments, it is envisioned that the end portions 323, 324 may be formed separately and mechanically coupled to the central region 322 by any of a variety of mechanisms, such as by welding, screws, rivets, press fitting, threaded connection, and the like.

Figure 4A:
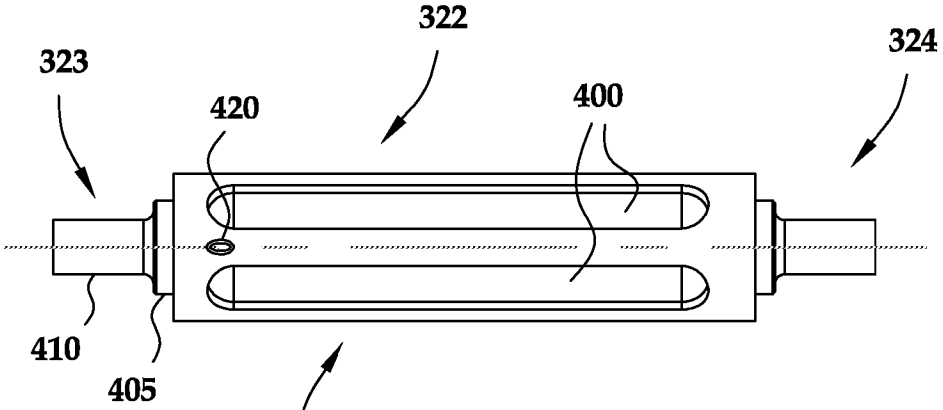
FIGS. 4A-4F shows various views of a shaft and a drum used in a wire access line drum assembly of FIGS. 1-3.
Figure 4D:
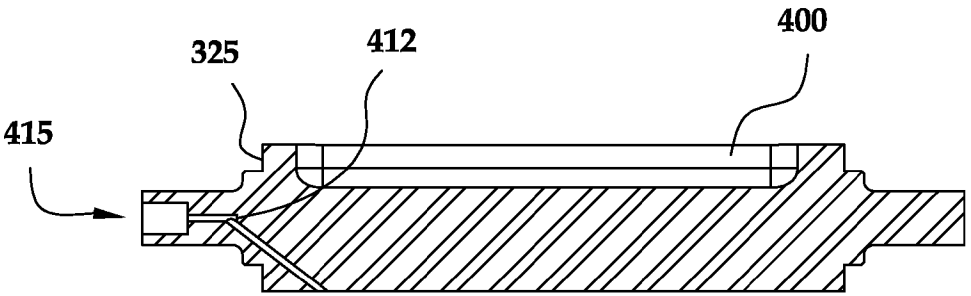
Figure 4C:
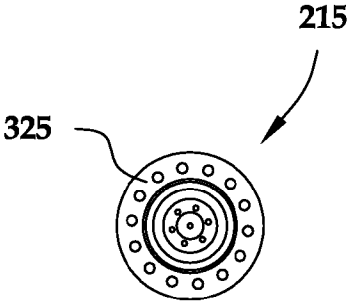
Figure 4B:
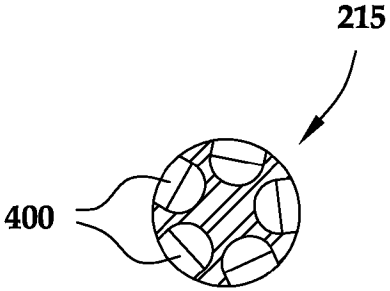
Figure 4F:
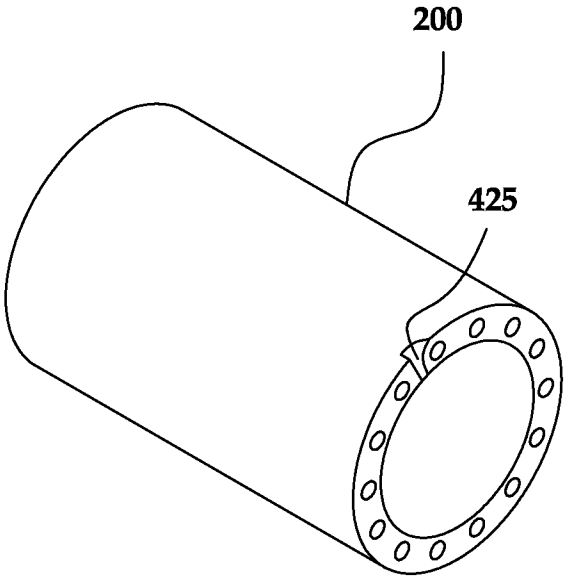
Figure 4E:
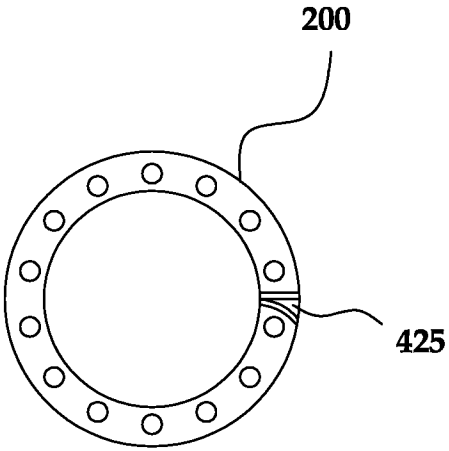

The shaft 215 may also include a passageway 412 through which the wire access line 130 may pass. The passageway 412 may extend through a first longitudinal end portion 415 and then radially outward to a port 420 on an outer surface of the central region 322. The port 420 may be generally aligned with an opening 425 extending through the drum 200 adjacent a first end portion of the drum 200, as is shown in FIGS. 3, 4E and 4F. The passageway 412 and opening 425 allow the wire access line 130 that is wound about the drum 200 to have a first end portion that may be routed through the drum 200 and the shaft 215 such that it exits the drum assembly 125 at the first longitudinal end portion 415 where it may be coupled to various stationary equipment (not shown). In some applications, it may be useful to couple the wire access line 130 to a conventional rotatable coupling (not shown) that may allow for the rotational movement of the drum assembly 125 and wire access line 130 without twisting and damaging the wire access line 130.

Figure 5:
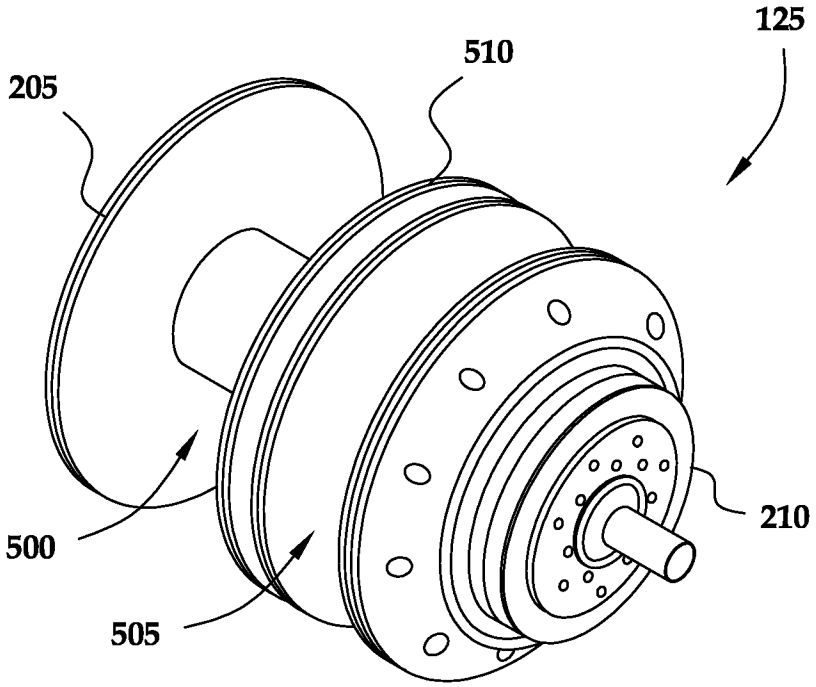
FIG. 5 shows a perspective view of an alternative embodiment of a wire access line drum assembly configured in a split arrangement.

Turning now to FIG. 5, an alternative embodiment is illustrated in which the wire access line drum assembly 125 is arranged in a split configuration. The split configuration provides two separate regions 500, 505 on which two separate wire access lines 130 may be stored or deployed. The split configuration drum assembly 125 of FIG. 5 includes a pair of end portions 205, 210 that are substantially similar to the end portions in the embodiment of FIG. 1. The regions 500, 505 are formed by a divider element 510 coupled to the drum 200 and positioned at a desired location between the first and second end portions 205, 210.

Figure 6A:
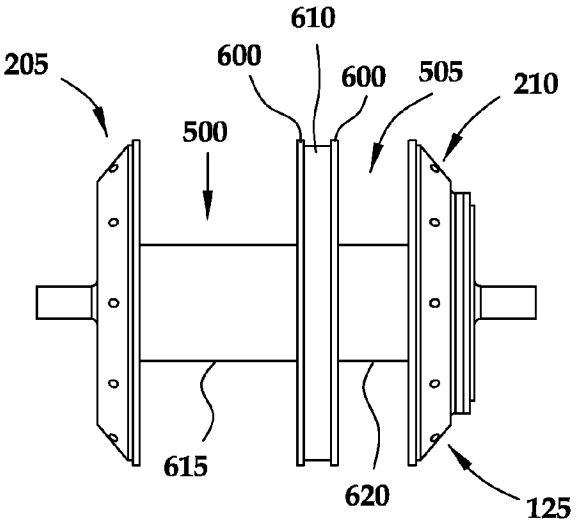
FIGS. 6A-6B show various side and cross sectional views of the split arrangement wire access line drum assembly of FIG. 5.
Figure 6B:
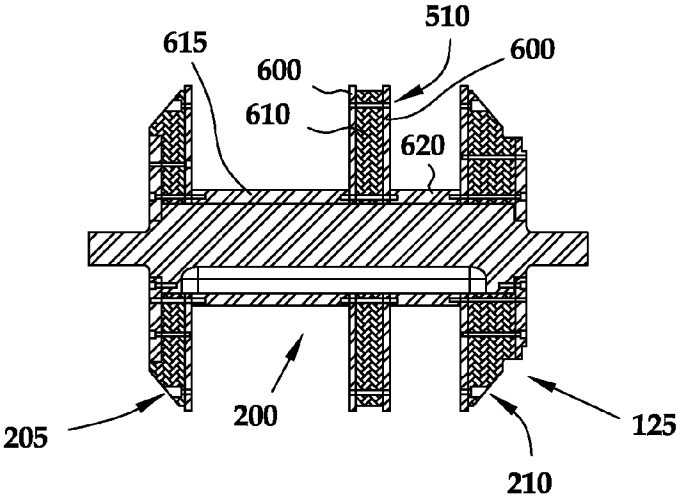

FIGS. 6A and 6B show a side view and a cross sectional view, respectively, of the split configuration drum assembly 125 of FIG. 5. The divider element 510 is comprised of two end plates 600 and a center connector 610. The drum assembly 125 includes two drums 615, 620 that are substantially similar to the drum 200 of FIG. 1, but varying in length so as to form the appropriate size for the regions 500, 505.

Each of the end plates 600 includes a plurality of bore holes that align with the threaded bore holes in the drums 615, 620 such that each of the end plates 600 may be bolted to one end of its associated drum 615, 620. The end plates 600 may then each be bolted to the center connector 610 via a set of corresponding bore holes in the end plates 600 and threaded bore holes in the center connector 610 so as to rigidly interconnect the drums 615, 620 and the divider element 510. The end portions 205, 210 may be coupled to the opposite ends of the drums 615, 620 in like manner to the end portions 205, 210 discussed in connection with the embodiment of FIG. 1.

Figure 7B:
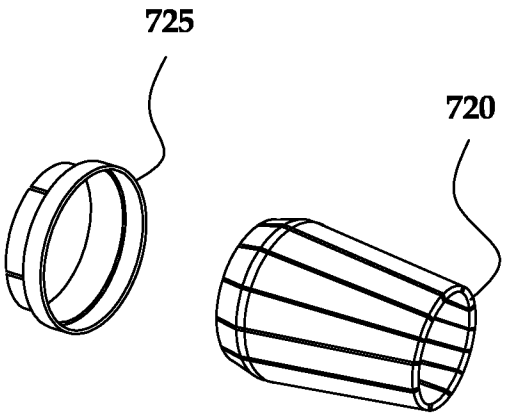
FIGS. 7A-7D show the components of an assembly that secures a wireline at a location on the exterior of the drum assembly of FIGS. 1-6 so that the wireline may be electrically coupled to various conventional electronic and/or recording equipment.
Figure 7A:
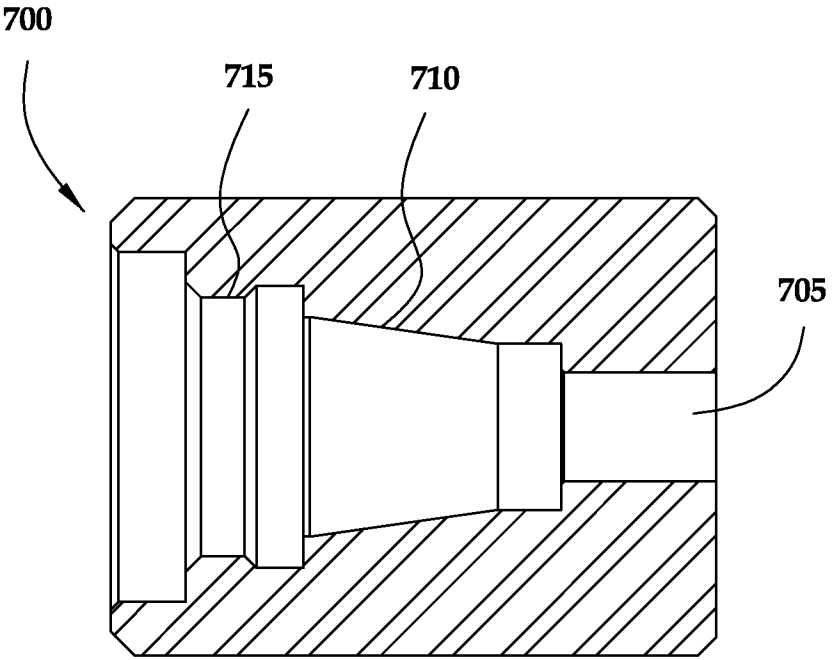

Turning now to FIGS. 7A-7E, an assembly useful for securing and protecting the wireline 130 is shown. As shown in FIG. 7A, an insert 700 may be positioned within an end portion of the shaft 215. The insert 700 includes a central bore 705 through which the wireline 130 may pass. The central bore 705 may include a tapered region 710 and threaded section 715 configured to receive a conventional collet 720 and collet nut 725, shown in FIG. 7B. The collet 720 may be inserted in the tapered region 710 and the collet nut 725 engages the threaded section 715 of the insert 700, such that tightening the collet nut 720 forces the collet 720 further into the tapered region 710 to clamp the wireline 130 securely therein. Those skilled in the art will appreciate that various size collets 720 and nuts 725 may be utilized in conjunction with different size wirelines 130.

Figure 7D:
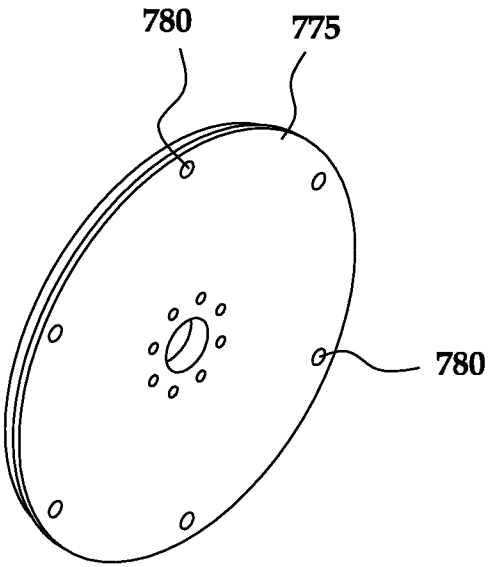
Figure 7C:
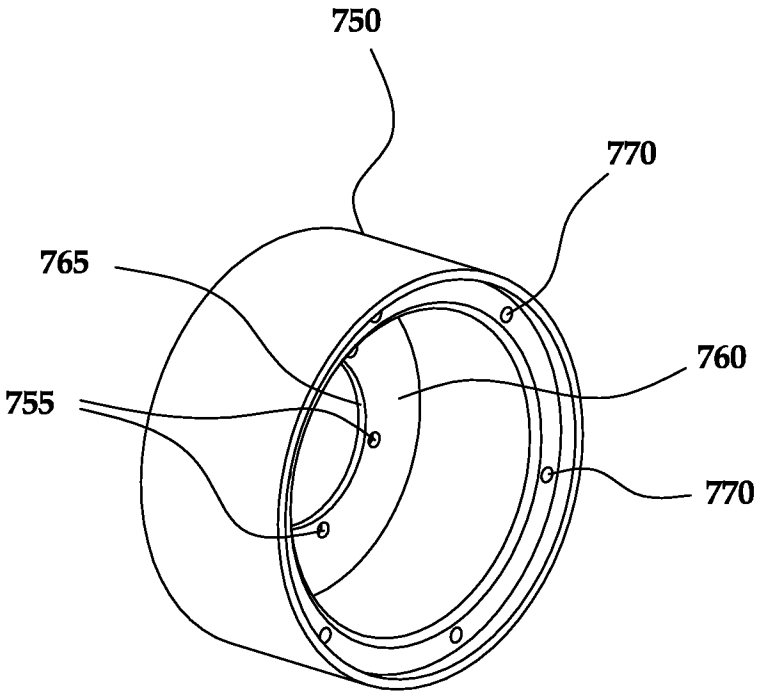

As seen in FIG. 7C, a junction box 750 may be coupled to the shaft 215 by, for example, a plurality of threaded bolts (not shown) extending through openings 755 in a rear surface 760 thereof and engaging threaded boreholes in the shaft 215. A central bore 765 in the rear surface 760 of the junction box 750 allows the wireline 130 to pass therein. The diameter of the central bore 765 is at least slightly smaller than an outer diameter of the insert 700, such that the junction box 750 operates to also retain the insert 700 within the shaft 215. As seen in FIG. 7D, a junction box cover 775 may be coupled to the junction box 750 via openings 780 though which threaded bolts (not shown) may be passed into threaded boreholes 770 in the junction box 750 to seal the interior of the junction box 750 against water intrusion.

Those skilled in the art will appreciate that in some applications it may be useful to pass electrical signals from the wireline 130 to recording or other electronic equipment (not shown) via a conventional slip ring arrangement (not shown) that may be coupled to the cover 775 of the junction box 750. The slip ring arrangement may be coupled or otherwise bolted to the cover 775 of the junction box 750 and an opening 780 in the cover 775 may be used to pass the wireline 130 to the slip ring arrangement. In some embodiments, various seals between the junction box 750 and the shaft 215, between the junction box 750 and the cover 775, and between the slip ring arrangement and the cover 775 may be useful to reduce the likelihood of water intrusion into the junction box 750.

Figure 8B:
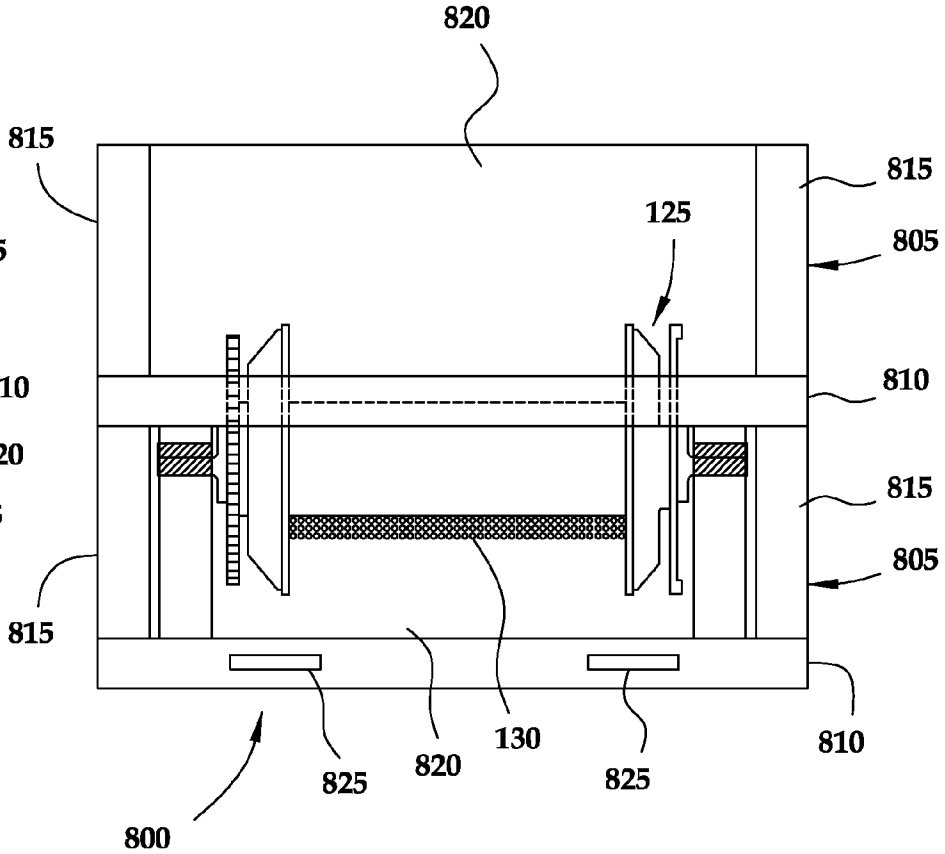
FIGS. 8A-8B show an end and side view of a storage system for maintaining a plurality of drum assemblies with well access lines of various sizes and lengths located thereon.
Figure 8A:
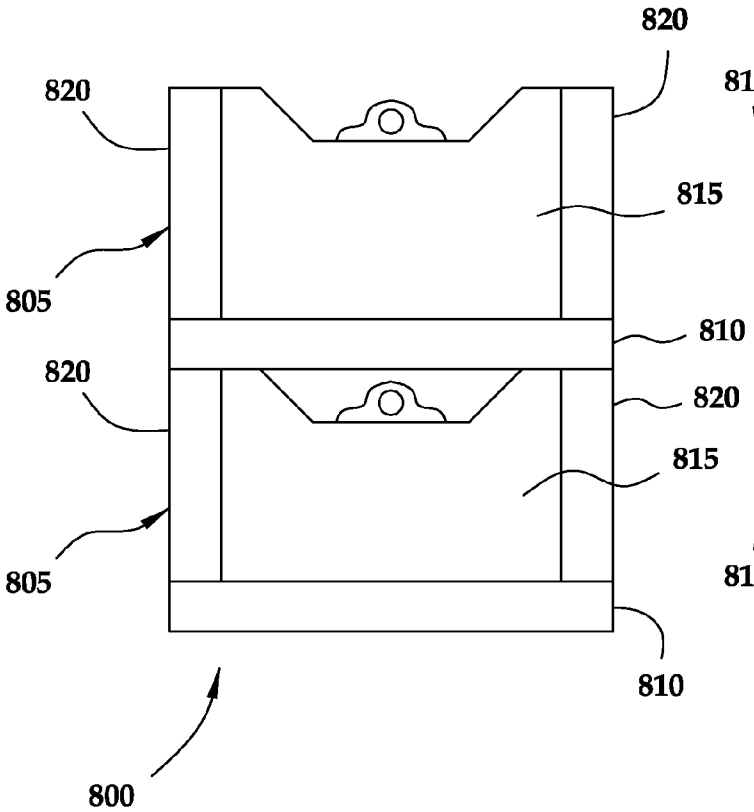

The construction of the drum assembly 125 is sufficiently strong to allow the well access line 130 to be stored thereon long term. Turning now to FIGS. 8A and 8B, an embodiment of a storage system 800 is shown. FIG. 8A shows an end view of one embodiment of the storage system 800, and FIG. 8B shows a side view of the storage system 800. The storage system 800 is comprised of a plurality of drum assemblies 125 located within stackable containers 805. Each of the containers 805 is substantially similar and has a floor 810, a pair of end walls 815, and a pair of front and rear walls 820. Each of the walls 815, 820 are sufficiently rigid to allow one or more containers to be stacked thereon with a drum assembly 125 and well access line 130 stored therein. The walls 815, 820 may be solid or have one or more openings formed therein to protect the drum assembly 125 and well access line 130 from inadvertent damage.

In one embodiment of the storage system 800, it may be useful to be able to select and remove a container 805 from the storage system 800 and place the container 805 directly onto a vehicle, trailer, skid, etc. for transportation to a well site. A lift truck may be used to select and move the container 805 from the storage system 800 to the vehicle, trailer skid, etc. Accordingly, each of the containers 805 may be configured to include one or more openings 825 in the floor 810 that are of sufficient size and spacing to allow the forks of the lift truck to be inserted therein so that one or more individual containers 805 may be transported from the storage system 800 to its desired location.

Those skilled in the art will appreciate that well access lines 130 of various type, length, diameter, etc. may be stored on the drum assemblies 125 in the storage system 800. Thus, an operator of the storage system 800 may quickly identify the desired type and size of wire access line 130 within the storage system 800, and then move the selected container to the vehicle, trailer skid, etc. for prompt transport to the well site. In this manner, each type and size of well access lines 130 may be stored in an organized manner, and yet remain available for quick and easy location and transportation to a work site.

The particular embodiments disclosed above are illustrative only, as the disclosed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the disclosed subject matter. Accordingly, the protection sought herein is as set forth in the claims below.

We claim:

1. A wire access line drum assembly, comprising:

a tubular drum having a first end, a second end, and an inner diameter of a first preselected size;

first and second end portions coupled to the first and second ends of the tubular drum; and a shaft extending at least partially within the tubular drum, the shaft having an outer diameter of a second preselected size substantially similar to the first preselected size, wherein the shaft and drum include interconnecting passages extending therethrough of a size suitable for routing a wire access line therethrough, wherein the interconnecting passages extend through a longitudinal end portion of the shaft and intersect with a sealed junction box.

2. The wire access line drum of claim 1, wherein the shaft further comprises a plurality of longitudinal recesses formed therein.

3. The wire access line drum of claim 1, further comprising a mechanical clamp located adjacent the passage extending through the shaft to receive and fixedly couple the wire access line.

4. The wire access line drum of claim 1, wherein the passage extending through the shaft has a tapered opening suitable for receiving a collet therein that allows the wire access line to pass therethrough and be secured against substantial movement.

5. The wire access line drum of claim 4, wherein the collet may be selected from one of a group of collets having varying interior diameter sizes to accommodate wire access lines of varying exterior diameter sizes.

6. The wire access line drum of claim 1, further comprising a second tubular drum and a third end portion, the second tubular drum being coupled between the second and third end portions to form a first region between the first and second end portions for receiving a first wire access line and a second regions between the second and third end portions for receiving a second wire access line.

7. The wire access line drum assembly of claim 1, wherein at least a portion of the tubular drum, first and second end portions, and the shaft are readily interchangeable with substantially similar components of various sizes to produce different capacity wire access line drum assemblies.

8. The wire access line drum assembly of claim 1, wherein the drum assembly is constructed from materials having sufficient strength to allow long term wire access line storage thereon.

9. The wire access line drum assembly of claim 8, wherein a plurality of the drum assemblies may be stored with a plurality of different wire access line pre-spooled and stored thereon.

10. The wire access line drum assembly of claim 9, wherein at least one of the drum assemblies with the wire access line pre-spooled thereon may be directly removed from storage and transported to a job site.

11. A drum storage system, comprising:

a plurality of wire access line drums, each having a wire access line pre-spooled thereon; and a rack designed to receive the plurality of wire access line drums in a configuration to permit one or more of the wire access lines to be retrieved from the rack and transported to a job site, wherein the wire access line drums further comprise:

a tubular drum having a first end, a second end, and an inner diameter of a first preselected size;

first and second end portions coupled to the first and second ends of the tubular drum; and a shaft extending at least partially within the tubular drum, the shaft having an outer diameter of a second preselected size substantially similar to the first preselected size wherein the shaft and drum include interconnecting passages extending therethrough of a size suitable for routing a wire access line therethrough, wherein the interconnecting passages extend through a longitudinal end portion of the shaft and intersect with a sealed junction box.

12. The drum storage system of claim 11, wherein a first portion of the plurality of wire access line drums are configured to have a wire access line of a first configuration spooled thereon and a second portion of the plurality of wire access line drums are configured to have a wire access line of a second configuration spooled thereon, such that an operator selects the wire access line configuration suitable for the job site to which the wire access line drum is to be transported.

13. The drum storage system of claim 11, wherein the shaft further comprises a plurality of longitudinal recesses formed therein.

14. The drum storage system of claim 11, further comprising a mechanical clamp located adjacent the passage extending through the shaft to receive and fixedly couple the wire access line.

15. The drum storage system of claim 11, wherein the passage extending through the shaft has a tapered opening suitable for receiving a collet therein that allows the wire access line to pass therethrough and be secured against substantial movement.

16. The drum storage system of claim 15, wherein the collet may be selected from one of a group of collets having varying interior diameter sizes to accommodate wire access lines of varying exterior diameter sizes.

17. The drum storage system of claim 11, further comprising a second tubular drum and a third end portion, the second tubular drum being coupled between the second and third end portions to form a first region between the first and second end portions for receiving a first wire access line and a second regions between the second and third end portions for receiving a second wire access line.

18. The drum storage system of claim 11, wherein at least a portion of the tubular drum, first and second end portions, and the shaft are readily interchangeable with substantially similar components of various sizes to produce different capacity wire access line drum assemblies.

19. The drum storage system of claim 11, wherein the drum assembly is constructed from materials having sufficient strength to allow long term wire access line storage thereon.

* * * * *